US012292200B2

(12) United States Patent
Farrel et al.

(10) Patent No.: US 12,292,200 B2
(45) Date of Patent: May 6, 2025

(54) SYSTEMS FOR APPLIANCE DOOR ASSEMBLY

(71) Applicant: Haier US Appliance Solutions, Inc., Wilmington, DE (US)

(72) Inventors: Caleb Farrel, Jeffersonville, IN (US); Evan Wade Kessick, Portage, MI (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 537 days.

(21) Appl. No.: 17/591,764

(22) Filed: Feb. 3, 2022

(65) Prior Publication Data

US 2023/0243511 A1 Aug. 3, 2023

(51) Int. Cl.

| | |
|---|---|
| ***F24C 15/02*** | (2006.01) |
| *F24C 15/04* | (2006.01) |
| *F24C 15/30* | (2006.01) |

(52) U.S. Cl.

CPC ..... *F24C 15/02* (2013.01); *F24C 15/024* (2013.01); *F24C 15/023* (2013.01); *F24C 15/04* (2013.01); *F24C 15/045* (2013.01); *F24C 15/30* (2013.01)

(58) Field of Classification Search

CPC ..... F24C 15/02; F24C 15/024; F24C 15/30; F24C 15/023; F24C 15/04; F24C 15/045

USPC ..... 126/273 A

See application file for complete search history.

(56) References Cited

U.S. PATENT DOCUMENTS

| | | | | |
|---|---|---|---|---|
| 5,881,710 | A * | 3/1999 | Davis | F24C 15/023 126/200 |
| 2013/0232756 | A1* | 9/2013 | Browne | B29C 61/00 29/428 |

FOREIGN PATENT DOCUMENTS

| | | | | |
|---|---|---|---|---|
| CA | 2770897 | A1 * | 2/2011 | E06B 3/7001 |
| CN | 105889994 | A | 8/2016 | |
| GB | 2581259 | A | 8/2020 | |
| KR | 100849544 | B1 | 7/2008 | |
| WO | WO-2021251609 | A1 * | 12/2021 | A47L 15/4265 |

OTHER PUBLICATIONS

WO 2021251609 A1—Translation (Year: 2021).*

* cited by examiner

*Primary Examiner* — Steven B McAllister
*Assistant Examiner* — Benjamin W Johnson
(74) *Attorney, Agent, or Firm* — Dority & Manning, P.A.

(57) ABSTRACT

An appliance door includes an inner door panel with a plurality of emboss locators and an outer door panel with a plurality of emboss locators. The outer door panel mounts to the inner door panel, and a plurality of handle brackets mount to the outer door panel. Additionally, each of the plurality of emboss locators of the inner door panel is engaged with a respective one of the plurality of emboss locators of the outer door panel.

20 Claims, 5 Drawing Sheets

SYSTEMS FOR APPLIANCE DOOR ASSEMBLY

FIELD OF THE INVENTION

The present subject matter relates generally to systems and methods for assembling appliance doors.

BACKGROUND OF THE INVENTION

Assembling doors for oven or range appliances is typically a multistep, multipiece process. In general, the door is made up of multiple subassemblies secured together by fasteners, such as screws. This process is commonly done by hand, with the assistance of slots and tabs, or with additional fixturing. Oven doors can typically be broken down into two subassemblies, an inner door and an outer door.

Conventionally, the inner and outer door subassemblies for oven doors are located and secured using only screws. This method does not locate the assemblies together precisely and must be controlled with a fixture or manually by the assembler to align the parts before the screws secure the assemblies together. Some manufactures use multiple tabs and slots to align inner and outer doors. This method works but is most effective when used in combination with a full outer door skin rather than a multi-piece construction. Also, having multiple tabs and slots can create a difficult assembly process when having to align numerous tabs.

BRIEF DESCRIPTION OF THE INVENTION

Aspects and advantages of the invention will be set forth in part in the following description, or may be apparent from the description, or may be learned through practice of the invention.

In an example embodiment, an appliance door includes an inner door panel with a first set of a plurality of emboss locators and an outer door panel with a second set of a plurality of emboss locators. The outer door panel mounts to the inner door panel, and a plurality of handle brackets mount to the outer door panel. Additionally, each of the plurality of emboss locators of the inner door panel is engaged with a respective one of the plurality of emboss locators of the outer door panel.

In another sample embodiment, an appliance defining a vertical direction, a lateral direction, and a transverse direction. The vertical, lateral, and transverse directions are mutually perpendicular. The appliance includes a cabinet which defines a cooking chamber. The cooking chamber comprising a front portion, which further defines an opening for the receipt of food items. The appliance also includes a door positioned at the front portion of the cooking chamber. The door is movable between a closed position and an open position to selectively enclose and thermally insulate the cooking chamber in the closed position and provide access to the cooking chamber in the open position. The door includes an inner door panel with a first set of a plurality of emboss locators, and an outer door panel with a second set of a plurality of emboss locators. The outer door panel mounts to the inner door panel, and a plurality of handle brackets mount to the outer door panel. Additionally, each of the plurality of emboss locators of the inner door panel is engaged with a respective one of the plurality of emboss locators of the outer door panel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
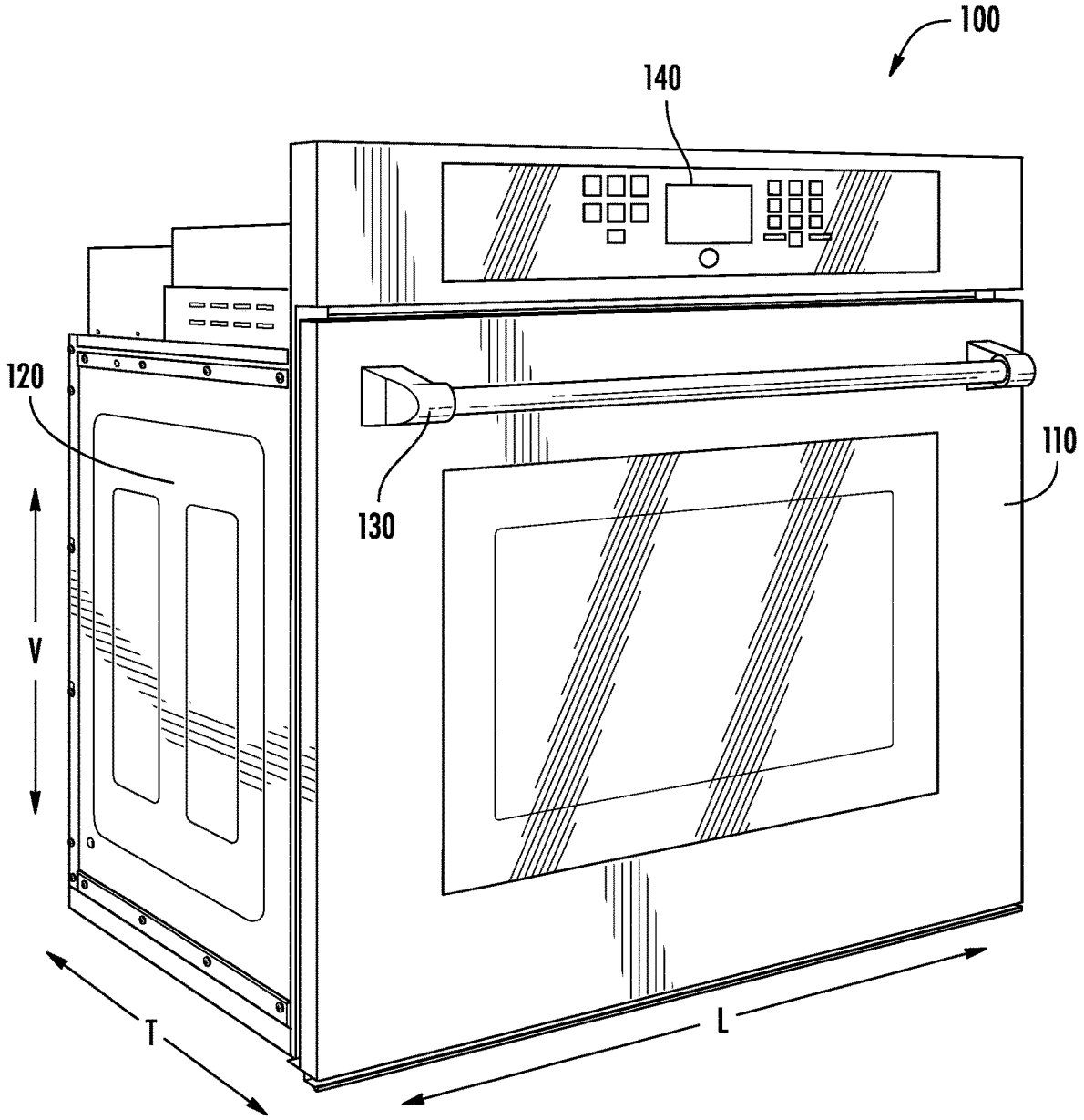
FIG. 1 is a perspective view of an oven appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Referring now to the figures, an appliance 100 according to an example embodiment of the present subject matter is shown in FIG. 1. Appliance 100 may be configured for the receipt of food items. Appliance 100 is shown as a wall oven, however one skilled in the art would understand that appliance 100 may be another appliance requiring a thermally insulating door, such as a range. Appliance 100 may define a vertical direction V, a lateral direction L, and a transverse direction T. The vertical direction V, lateral direction L, and transverse direction T may be mutually perpendicular and form an orthogonal direction system.

As shown in FIG. 1, appliance 100 includes a door 110 coupled to cabinet 120. Door 110 includes a handle 130 for a user to use to open or close door 110. Additionally, cabinet 120 includes a user interface 140. User interface 140 may be used to control appliance 100. Appliance 100 may also include an electrical or gas heating system (not shown). It is understood by one of skill in the art that an oven has a heating system and thus a description of a heating system will be omitted for brevity.

Figure 2:
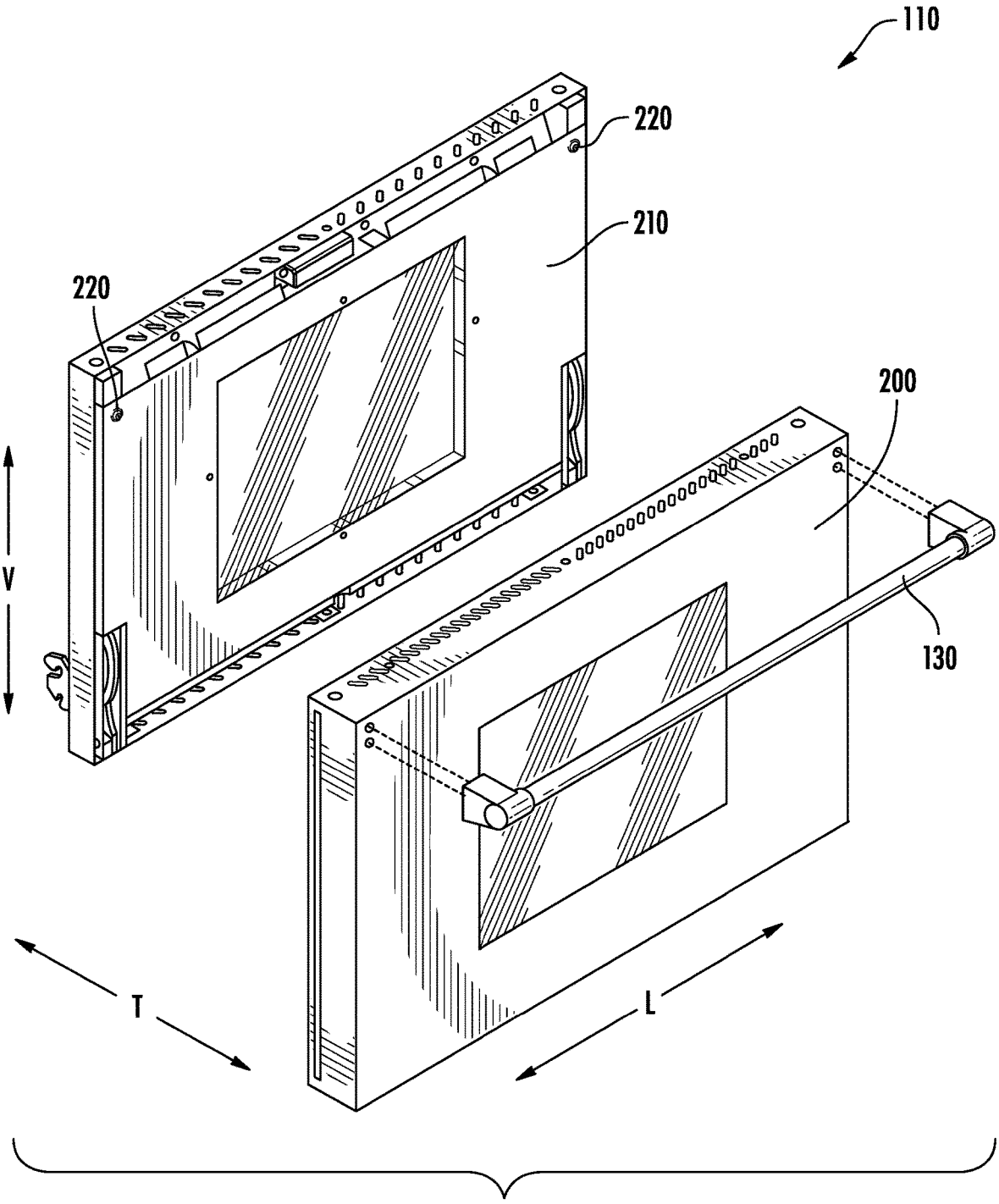
FIG. 2 is an exploded perspective view of a door of the example appliance of FIG. 1.
Figure 3:
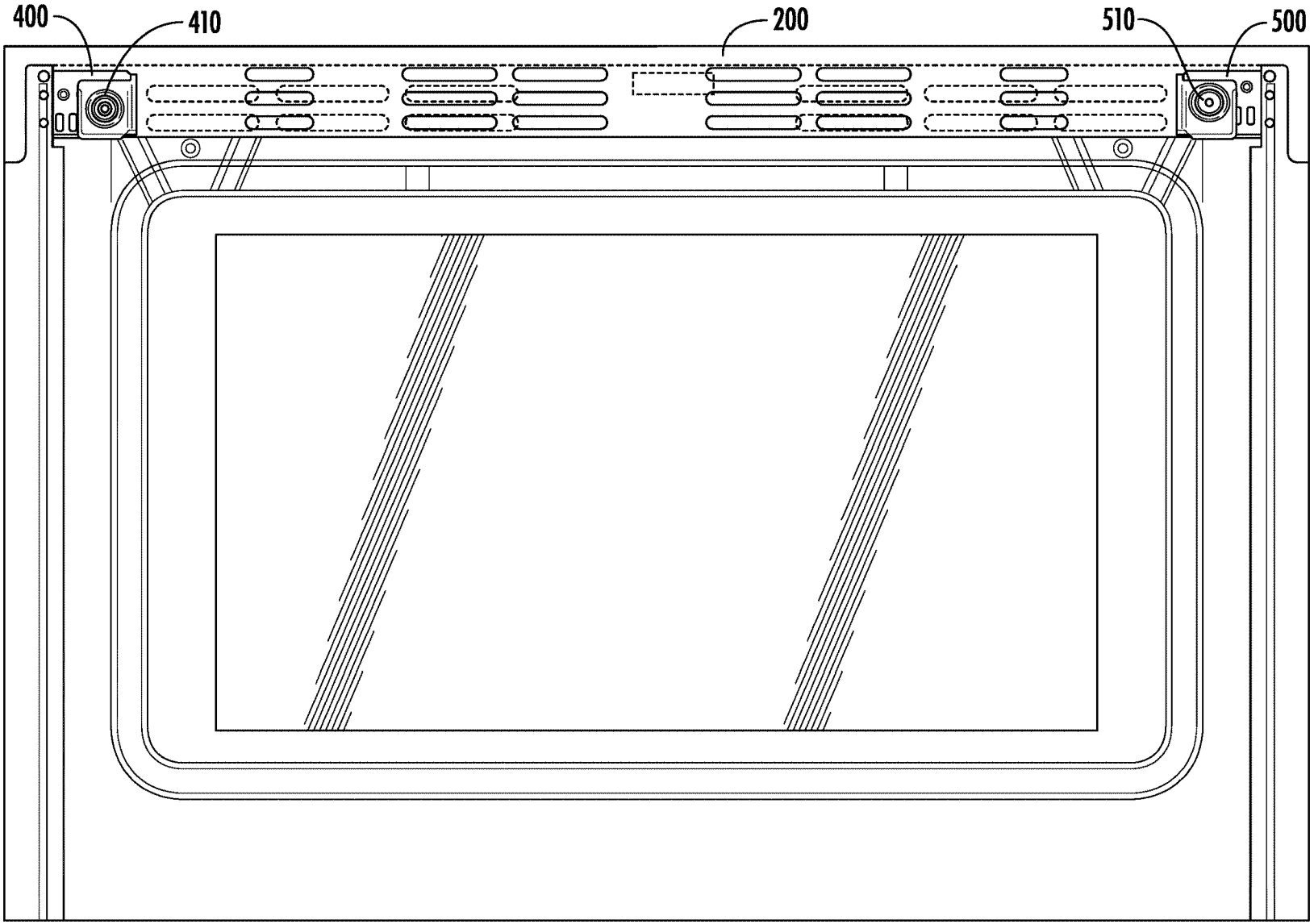
FIG. 3 is a rear view of the outer door panel of FIG. 2.

With reference to FIGS. 2 and 3, FIG. 2 illustrates a perspective view of door 110 split into respective subassemblies. An outer door panel 200 fastens to an inner door panel 210 to form door 110. The fasteners used for fastening outer door panel 200 to inner door panel 210 may be screws, bolts, etc. Door 110 may be thermally insulating, e.g., to limit heat transfer from inner door panel 210 that may face a cooking chamber of appliance 100 when door 110 is closed and outer door panel 200 that faces an exterior of appliance 100 and may be exposed to touch during operation of appliance 100. To aid the fastening of outer door panel 200 and inner door panel 210, emboss locators 220 are positioned on inner door panel 210. As may be seen in FIG. 3, outer door panel 200 includes handle bracket 400 (FIG. 4) with emboss locator 410 (FIG. 4) and handle bracket 500 (FIG. 5) with emboss locator 510 (FIG. 5). In the present example embodiment, each of the emboss locators 220, 410, and 510 may be deformations stamped into the sheet metal of the respective location where each emboss is a positioned. One skilled in the art would understand the embosses may be other types of fabricated mating pieces, such as plastic pieces, or die-cast pieces. Emboss locators 220 may have complimentary form to emboss locator 410 and emboss locator 510. When a user aligns all emboss locators 220, 410, and 510, outer door panel 200 and inner door panel 210 subassemblies set into a fixed position to ease the process for the user to fasten outer door panel 200 to inner door panel 210 to produce door 110. Thus, e.g., emboss locators 220, 410, and 510 may position outer and inner door panels 200, 210 for assembly together with fasteners, such as screws.

Figure 4:
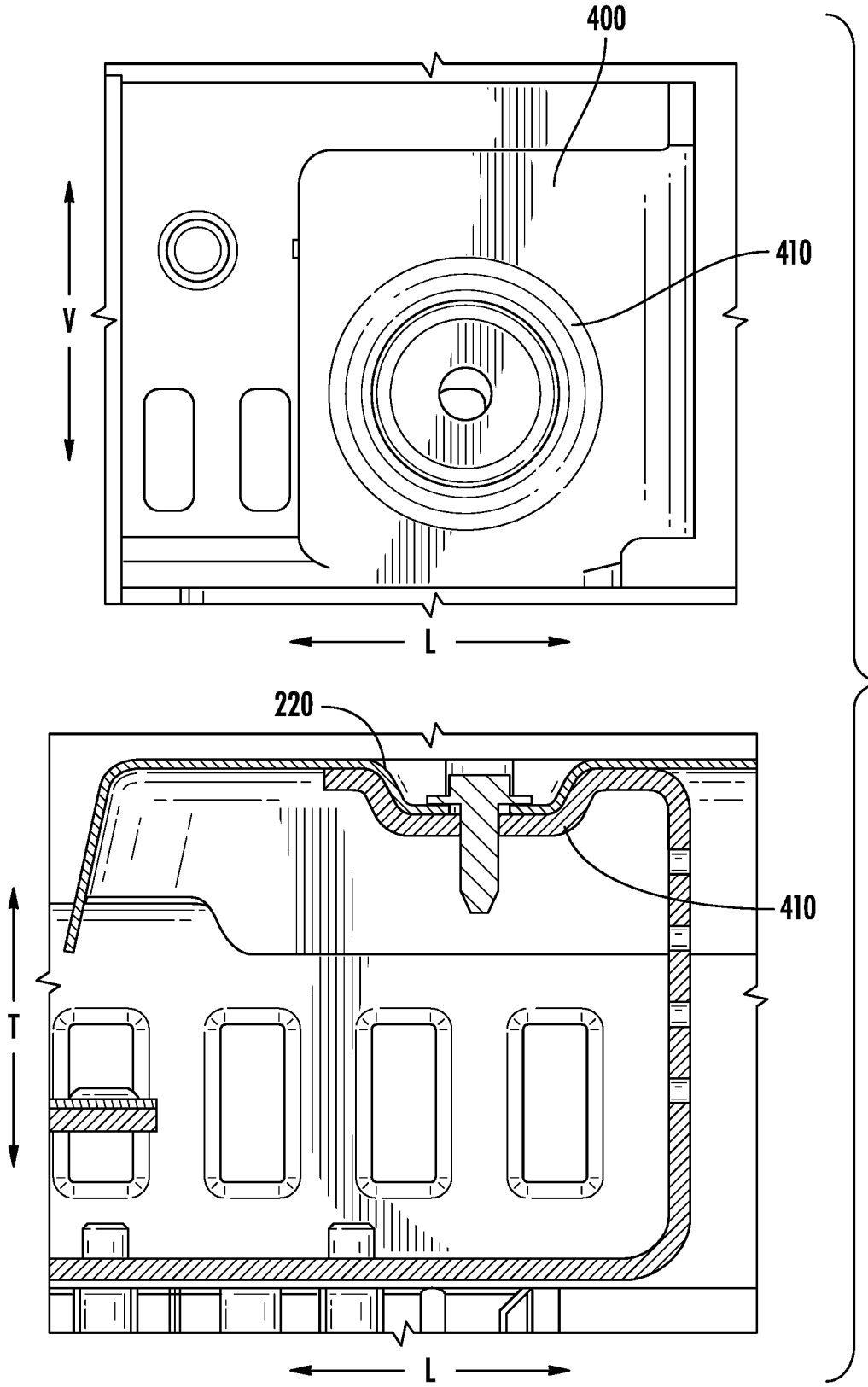
FIG. 4 is a partial section view of a handle bracket from the outer door panel of FIG. 3.
Figure 5:
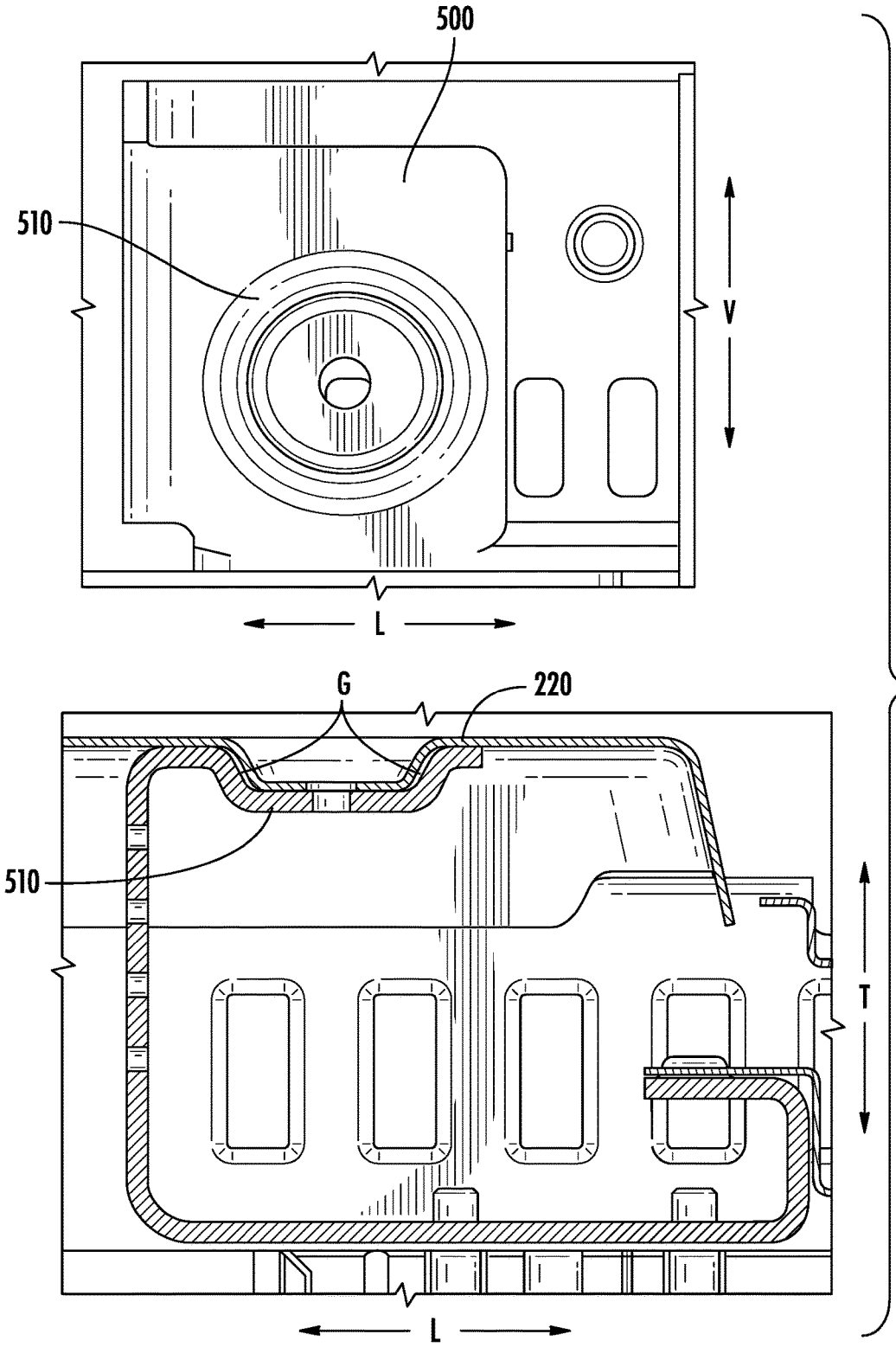
FIG. 5 is another partial section view of another handle bracket from the door of FIG. 3.

With reference to FIGS. 4 and 5, FIG. 4 illustrates a partial section view of handle bracket 400. Handle bracket 400 couples handle 130 to outer door panel 200, while also having an emboss locator 410. Moreover, handle 130 may be mounted to outer door panel 200 at handle bracket 400, e.g., with fasteners that extend through handle bracket 400 into handle 130. FIG. 5 illustrates a section view of handle bracket 500. Handle bracket 500 couples handle 130 to outer door panel 200, while also having an emboss locator 510. Moreover, handle 130 may also be mounted to outer door panel 200 at handle bracket 500, e.g., with fasteners that extend through handle bracket 500 into handle 130. Emboss locators 220 on inner door panel 210 may be considered the first set of embosses. Emboss locator 410 and emboss locator 510 on outer door panel 200 may be considered the second set of embosses. Emboss locators 220 on inner door panel 210 may be four-way direction locators, e.g., such that the emboss locators 220 provide limited movement in four (4) directions: up, down, left, and right, and/or along both the lateral direction L and vertical direction V when the door 130 is closed (FIG. 1). Emboss locators 220 on inner door panel 210 may be circular shaped embosses, such as truncated cones. When paired with emboss locator 410 on outer door panel 200, the circular shaped embosses 220, 410 may be complimentary concentric circles, or complimentary truncated cones, and the paired embosses 220, 410 behave as a four-way directional locator. While emboss locator 410 is meshed with one of the emboss locators 220, outer door panel 200 and inner door panel 210 may still angularly rotate about an axis parallel to the transverse direction T.

The other emboss locator of emboss locators 220 on inner door panel 210, may mesh with emboss locator 510 on outer door panel 200. Emboss locator 510 on outer door panel 200 may be an oval-shaped emboss, or an oval-shaped truncated cone. As may be seen in FIG. 5, gap G forms from the oval shape of emboss locator 510 on outer door panel 200 being meshed with the circular shape of emboss locators 220 on inner door panel 210. As such, emboss locator 510 acts as a two-way locator, limiting the movement of the meshing one of the emboss locators 220 in the vertical direction V when the door 130 is closed (FIG. 1), and thus eliminating the ability of outer door panel 200 and inner door panel 210 from angularly rotating. Thus, limiting the movement of one of the emboss locators 220 in the vertical direction V and the other of the emboss locators 220 in both the vertical and lateral directions V, L, limits the movement of outer door panel 200 and inner door panel 210 during assembly without over-constraining such that the assembly is difficult.

In the present example embodiment, both of emboss locators 220 on the inner door panel 210 include through-holes for screws, while emboss locator 410 and emboss locator 510 on outer door panel 200 both include threads to threadedly engage the screw, fastening outer door panel 200 and inner door panel 210 together. Also, in the present example embodiment emboss locator 410 and emboss locator 510 on outer door panel 200 are positioned on respective handle brackets 400 and 500, whereas in alternative example embodiments the emboss locators 410 and 510 on outer door panel 200 could be positioned directly on other components of outer door panel 200. Additionally, in the present example embodiment, emboss locator 410 and emboss locator 510 on outer door panel 200 both are located vertically at the top portion of outer door panel 200 and emboss locators 220 on inner door panel 210 both are located vertically at the top portion of inner door panel 210, and each of the embosses 210, 410, 510 are spaced apart in opposing corners laterally, with respect to each door panel 200, 210. In an alternative example embodiment, while maintaining the spacing along the lateral direction L, the embosses 210, 410, 510 may be at any height in the vertical direction V.

As may be seen from the above, by coupling the emboss features between the inner and outer door panels, 210 and 200 respectively, door panel assemblies may properly align during the fastening process. One pair of embosses may be concentric to each other with a small amount of assembly clearance, and a second pair of embosses may be tightly fit together in the vertical direction but have larger horizontal clearances. Thus, creating a slot-type feature to control the angular rotation of the mating assemblies. The embosses better align the assemblies together as well as allows for larger clearance holes making inner door panel 210 and outer door panel 200 of door 110 easier to fasten together during the assembly process.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance door defining a vertical direction, a lateral direction, and a transverse direction, the appliance door comprising:

an inner door panel comprising a first plurality of emboss locators, the first plurality of emboss locators being spaced apart along the lateral direction, each emboss locator of the first plurality of emboss locators comprising a first mating surface extending along a first vertical plane of the appliance door, each emboss locator of the first plurality of emboss locators defining a first through hole extending through the first mating surface along the transverse direction; and an outer door panel mounted to the inner door panel, the outer door panel comprising a second plurality of emboss locators corresponding to the first plurality of emboss locators, each emboss locator of the second plurality of emboss locators comprising a second mating surface extending along a second vertical plane of the appliance door, each emboss locator of the second plurality of emboss locators defining a second through hole extending through the second mating surface along the transverse direction, wherein each first mating surface of the first plurality of emboss locators is in direct contact with a corresponding second mating surface of the second plurality of emboss locators, and wherein each first through hole of the first plurality of emboss locators is coaxially aligned with a corresponding second through hole of the second plurality of emboss locators to receive a fastener therethrough.

2. The appliance door of claim 1, wherein one of the emboss locators of the first plurality of emboss locators on the inner door panel defines a circular cross-sectional area, wherein another one of the emboss locators of the first plurality of emboss locators on the inner door panel defines an oval cross-sectional area, and wherein each emboss locator of the second plurality of emboss locators on the outer door panel defines a circular cross-sectional area.

3. The appliance door of claim 1, wherein one of the emboss locators of the second plurality of emboss locators on the outer door panel defines a circular cross-sectional area, wherein another one of the emboss locators of the second plurality of emboss locators on the outer door panel defines an oval cross-sectional area, and wherein the first plurality of emboss locators on the inner door panel each define a circular cross-sectional area.

4. The appliance door of claim 1, wherein the appliance door is mounted on a cabinet of a wall oven or a range.

5. The appliance door of claim 1, wherein the outer door panel comprises a plurality of handle brackets.

6. The appliance door of claim 1, wherein the first plurality of emboss locators on the inner door panel and the second plurality of emboss locators on the outer door panel are deformations stamped into sheet metal panels.

7. The appliance door of claim 1, wherein the first plurality of emboss locators and the second plurality of emboss locators are plastic pieces with complimentary form.

8. The appliance door of claim 1, wherein the first plurality of emboss locators and the second plurality of emboss locators are die cast pieces with complimentary form.

9. The appliance door of claim 1, wherein the second plurality of emboss locators of the outer door panel are located on a plurality of handle brackets mounted to the outer door panel.

10. The appliance door of claim 1, wherein one of the first plurality of emboss locators and the second plurality of emboss locators engages between the inner door panel and outer door panel to control both the vertical direction and the transverse direction, and wherein another one of the first plurality of emboss locators or the second plurality of emboss locators engages between the inner door panel and outer door panel to control either the vertical direction or the transverse direction.

11. An appliance defining a vertical direction, a lateral direction, and a transverse direction, the vertical, lateral, and transverse directions being mutually perpendicular, the appliance comprising:

a cabinet defining a cooking chamber, the cooking chamber comprising a front portion, the front portion of the cooking chamber defining an opening; and a door positioned at the front portion of the cooking chamber and movable between a closed position and an open position to selectively enclose and thermally insulate the cooking chamber in the closed position and provide access to the cooking chamber in the open position, the door comprising, an inner door panel comprising a first plurality of emboss locators, the first plurality of emboss locators being spaced apart along the lateral direction, each emboss locator of the first plurality of emboss locators comprising a first mating surface extending along a first vertical plane of the door, each emboss locator of the first plurality of emboss locators defining a first through hole extending through the first mating surface along the transverse direction, an outer door panel mounted to the inner door panel, the outer door panel comprising a second plurality of emboss locators corresponding to the first plurality of emboss locators, each emboss locator of the second plurality of emboss locators comprising a second mating surface extending along a second vertical plane of the door, each emboss locator of the second plurality of emboss locators defining a second through hole extending through the second mating surface along the transverse direction, wherein each first mating surface of the first plurality of emboss locators is in direct contact with a corresponding second mating surface of the second plurality of emboss locators, and wherein each first through hole of the first plurality of emboss locators is coaxially aligned with a corresponding second through hole of the second plurality of emboss locators to receive a fastener therethrough.

12. The appliance of claim 11, wherein one of the emboss locators of the first plurality of emboss locators on the inner door panel defines a circular cross-sectional area, wherein another one of the emboss locators of the first plurality of emboss locators defines an oval cross-sectional area, and wherein each emboss locator of the second plurality of emboss locators on the outer door panel defines a circular cross-sectional area.

13. The appliance of claim 11, wherein one of the emboss locators of the second plurality of emboss locators on the outer door panel defines a circular cross-sectional area, wherein the other one of the emboss locators of the second plurality of emboss locator defines an oval cross-sectional area, and wherein the first plurality of emboss locators on the inner door panel defines a circular cross-sectional area.

14. The appliance of claim 11, wherein the appliance is one of a wall oven, or a range.

15. The appliance of claim 11, wherein the outer door panel comprises a plurality of handle brackets.

16. The appliance of claim 11, wherein the first plurality of emboss locators on the inner door panel and the second plurality of emboss locators on the outer door panel are deformations stamped into sheet metal.

17. The appliance of claim 11, wherein the first plurality of emboss locators and the second plurality of emboss locators are plastic pieces with matching form.

18. The appliance of claim 11, wherein the first plurality of emboss locators and the second plurality of emboss locators are die cast pieces with matching form.

19. The appliance of claim 11, wherein the second plurality emboss locators of the outer door panel are located on a plurality of handle brackets mounted to the outer door panel.

20. The appliance of claim 11, wherein one of the first plurality of emboss locators or the second plurality of emboss locators engages between the inner door panel and outer door panel to control both the vertical direction and the transverse direction, and the other of the first plurality of emboss locators or the second plurality of emboss locators engages between the inner door panel and outer door panel to control either the vertical direction or the transverse direction.

* * * * *